United States Patent [19]

Prendergast

[11] Patent Number: 4,573,664

[45] Date of Patent: Mar. 4, 1986

[54] APPARATUS AND METHOD FOR REMOVING INCLUSIONS

[75] Inventor: Ian D. Prendergast, State College, Pa.

[73] Assignee: Allied Corporation, Morris Township, Morris County, N.J.

[21] Appl. No.: 687,043

[22] Filed: Dec. 28, 1984

[51] Int. Cl.[4] ..... C21B 3/04

[52] U.S. Cl. ..... 266/44; 266/230

[58] Field of Search ..... 266/220, 227, 228, 229, 266/230, 275, 44; 164/437; 222/590, 594, 603, 604, 605

[56] References Cited

U.S. PATENT DOCUMENTS 4,330,327 5/1982 Pryor ..... 75/76

FOREIGN PATENT DOCUMENTS 0004349 1/1981 Japan ..... 222/594

1044936 9/1983 U.S.S.R. ..... 266/228

*Primary Examiner*—L. Dewayne Rutledge
*Assistant Examiner*—Robert L. McDowell
*Attorney, Agent, or Firm*—Jay P. Friedenson

[57] ABSTRACT

The present invention provides an apparatus useful for the removal of inclusions from a molten ferrous-based alloy in a continuous casting process. The apparatus includes a replaceable barrier to flow, that has numerous perforations. The individual perforations disturb molten alloy flow sufficiently to enhance inclusion agglomeration. As a result, molten alloy exiting from the perforations is agglomerated inclusions-enriched, compared to molten alloy entering the perforations. The agglomerated inclusions are enabled to float to the molten alloy surface prior to exiting from a tundish in which the replaceable barrier is used. Also provided by the present invention is an improved continuous casting process.

11 Claims, 7 Drawing Figures

FIG. 1
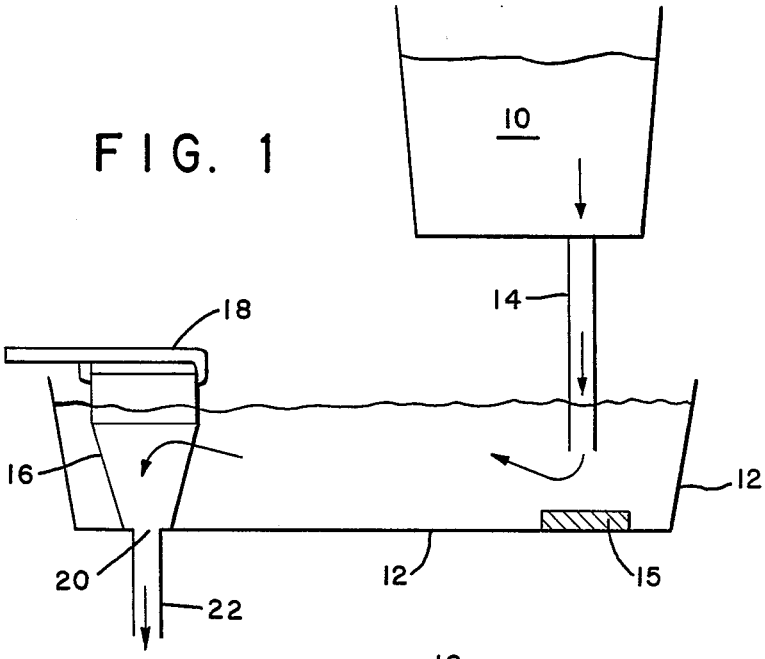
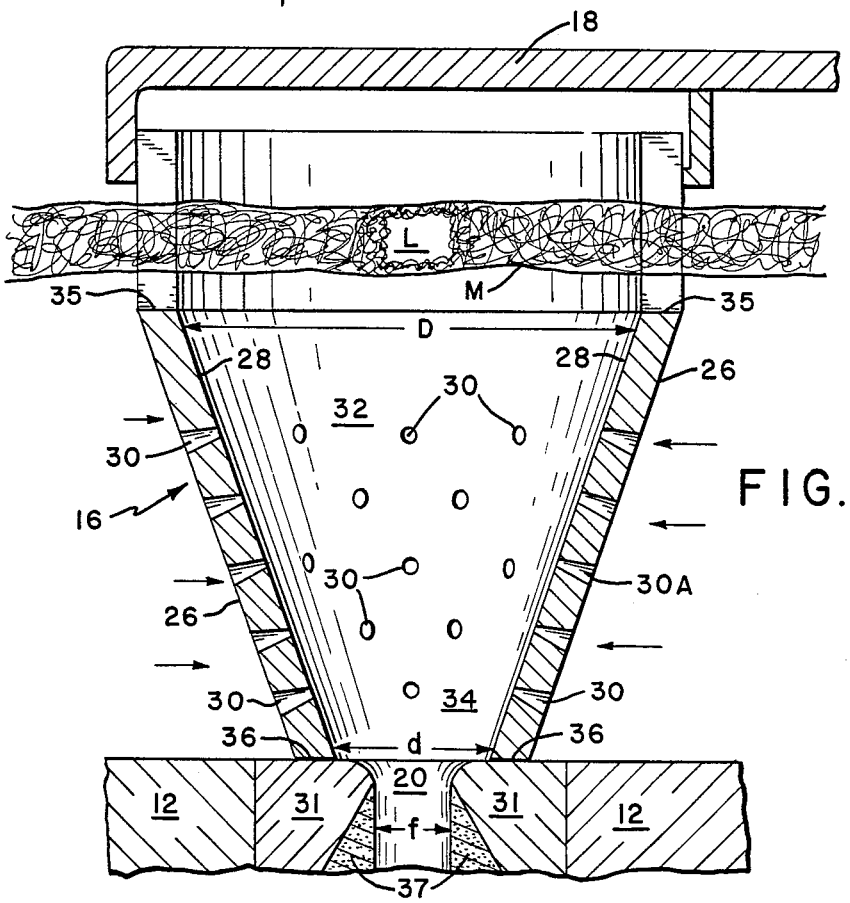
FIG. 2

APPARATUS AND METHOD FOR REMOVING INCLUSIONS

TECHNICAL FIELD

This invention relates to an apparatus for use in the continuous casting of ferrous-based alloys, and to an improved continuous casting process based upon this apparatus.

BACKGROUND ART

Continuous casing of ferrous-based alloys is hindered by inclusion build-up and concentration in the upper nozzle, leading to clogging of the nozzle and resultant shut-down of the operation to clean the nozzle. Furthermore, the presence of inclusions in the cast material results in a lower quality cast material and in some cases even requires the cast material to be rejected. Therefore, molten ferrous-based alloy has been treated to hinder inclusion build-up or to remove inclusions, before, during, or after passing from the ladle to the tundish and on to the mold.

Presently used methods of inclusion removal are numerous. One approach is to provide the tundish with dams and wiers to give "dead spots" and differing flow characteristics, so as to allow the lighter inclusions to agglomerate and float to the surface. This approach is not sufficiently effective. Another approach is the use of porous plugs in the tundish, through which argon gas is bubbled, but this approach is also not adequate. Other approaches have built into the tundish "mazes", "picket fences" and other flow regulators and non-removable filters. Bed filtration of a molten alloy is illustrated by U.S. Pat. No. 4,330,327 to Pryor.

A further approach is to add mold powders to the mold so as to dissolve inclusions, but the resulting mass is not always removed from the alloy before it solidifies. Electromagnetic stirring and braking are also used to disperse or float out the inclusions in the mold, with mixed results.

The absence of efficient inclusion removal prior to the molten alloy passing into the upper nozzle has required the use of procedures to avoid clogging. For example, argon gas is bubbled through a porous upper nozzle, through porous plates on the slide gate, or through porous inserts in the submerged entry nozzle, to decrease, but not eliminate, inclusion build-up and eventual clogging.

Accordingly, there is a long-felt need for an improved apparatus useful in the continuous casting of ferrous-based alloys, for removing inclusions from the molten alloy. Such an improved apparatus would be especially useful if it removed inclusions prior to passage of the molten alloy into the upper nozzle. Moreover, such an improved apparatus would provide an even greater contribution to the art if it were based upon an inclusion-removing element that could be easily installed and removed, and hence could be replaced with minimal disruption of the continuous casting process. Clearly, such an apparatus would make possible an improved process for the continuous casting of ferrous-based alloys.

DISCLOSURE OF THE INVENTION

It is accordingly an object of the present invention to provide an improved apparatus useful in the continuous casting of ferrous-based alloys, for effecting inclusion removal from the molten alloy.

It is a further object of the present invention to provide an apparatus of this type that removes inclusions, prior to the molten alloy passing into the upper nozzle.

It is an even further object to provide an apparatus of this type that is based upon an inclusion-removing element that can be easily installed and removed, and that therefore can be replaced with minimal disruption of the continuous process.

It is a still further object to provide an improved process for the continuous casting of ferrous-based alloys.

Additional objects, advantages and novel features of the present invention are set forth in the description that follows, and in part will become apparent to those skilled in the art upon examination of the following description or may be learned by practice of the invention. The objects and advantages of the invention may be realized and attained by means of instrumentalities and combinations particularly pointed out in the appended claims.

To achieve the foregoing objects and in accordance with the purpose of the present invention, as embodied and broadly described herein, there is provided an apparatus useful for the removal of inclusions from a molten ferrous-based alloy in a continuous casting process. The apparatus includes a replaceable barrier to flow, that has numerous flow-altering perforations. The individual perforations allow an inclusions-containing molten alloy to pass through, and yet disturb molten alloy flow sufficiently to enhance inclusion agglomeration. As a result, molten alloy exiting from the perforations is agglomerated inclusions-enriched, compared to molten alloy entering the perforations.

The barrier to flow has an upper diameter that is of a dimension relative to a lower diameter thereof, that enables agglomerated inclusions within the barrier to float to the molten alloy surface. The lower diameter of the barrier is sufficient to provide free access of the molten alloy to an outlet from a tundish in which the barrier is to be placed. The barrier is arranged above the outlet. The sum of the flow-limiting, cross-sectional areas of the individual perforations is at least about equivalent to the outlet cross-sectional flow area.

Also provided by the present invention is an improved process for continuous casting of a molten ferrous-based alloy. The process includes passing an inclusions-containing molten alloy through numerous flow-disturbing perforations in a barrier to flow. Molten alloy flow within the individual perforations is sufficiently altered to enhance inclusion agglomeration. As a result, molten alloy exiting from the perforations is agglomerated inclusions-enriched, compared to molten alloy entering the perforations. As a next essential step, agglomerated inclusions are enabled to float to the molten alloy surface. As a result, inclusions are removed from the molten ferrous-based alloy.

In the drawing and in the detailed description of the invention that follows, there are shown and essentially described only preferred embodiments of this invention, simply by way of illustration of the best mode contemplated by me of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing, which forms a part of the specification of the present invention, and which depicts preferred embodiments of an apparatus in accordance with the present invention.

FIG. 1 is a schematic diagram showing an improved continuous casting process based upon a preferred embodiment of an apparatus in accordance with the present invention;

FIG. 2 is a detailed, cross-sectional view of a barrier to flow 16 of FIG. 1, that additionally shows the cross-sectional configuration of perforations 30 and details of a well block 31 situated below barrier 16;

BEST MODE FOR CARRYING OUT THE INVENTION

Figure 3:
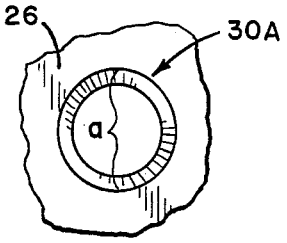
FIGS. 3 and 4 are magnified views of tapered perforation 30A of FIG. 2.

As explained above, the present invention is directed to a novel apparatus useful in the continuous casting of a molten ferrous-based alloy, and to an improved continuous casting process using this unique apparatus. More precisely, the present invention is directed to the removal of inclusions from the molten alloy. An advantage of the invention is that inclusions are removed prior to passage of the molten alloy into the upper nozzle. As will become better understood from the description that follows, this novel inclusion-removing element enhances the aggregration of inclusions, and enables the aggregates to float to the molten alloy surface.

Beneficially, the present invention is useful for the removal of inclusions from molten ferrous-based alloys including, but not limited to, stainless steel and carbon steel.

Prior to describing the details of the present invention, an overview of an improved continuous casting process based upon a preferred embodiment of an apparatus in accordance with the present invention, is now provided. Referring to FIG. 1, a molten ferrous-based alloy containing inclusions is supplied from a ladle 10 to a tundish 12 via a shroud 14. The molten alloy impacts pad 15 of the tundish and flows the length of the tundish until it reaches a unique inclusion-removing element 16, which is held in place by hold down equipment 18. Element 16 is easily installed and removed, and therefore is replaceable with minimal disruption of the casting process. The molten alloy passes through perforations (not shown) of element 16 and then exits from the tundish through an outlet 20. The molten alloy is then fed through a submerged entry nozzle 22 into a mold (not shown).

Referring now to FIG. 2, a preferred embodiment of an apparatus in accordance with the present invention will now be described in detail, with emphasis on the novel inclusion-removing element thereof. As indicated, a unique feature of the present invention is barrier to flow 16, which removes inclusions from the molten alloy. To this end, barrier 16, which has an outer circumferential wall 26 and an inner circumferential wall 28, is provided with numerous perforations 30, which allow the molten alloy to pass therethrough.

Prior to passing into the perforations, the molten alloy is typically characterized by laminar flow. The perforations alter the flow characteristics of the molten alloy, as the inclusions-containing molten alloy passes through the perforations, to cause mixing, stirring and agglomeration of the inclusions. As a result, inclusion agglomeration is enhanced. Accordingly, molten alloy exiting from the perforations, is agglomerated inclusions-enriched, compared to molten alloy entering the perforations. Therefore, barrier 16 functions dissimilar to a conventional filter, which purifies a fluid by preventing solid particles and impurities from passing through the pores thereof.

Preferably, the perforations transform the flow of the molten alloy to turbulent flow, which produces a high degree of mixing and of inclusion agglomeration. The flow pattern induced by a perforation depends upon factors including the cross-sectional perforation configuration, which may be, for example, tapered, counterbored or cylindrical.

Figure 5:
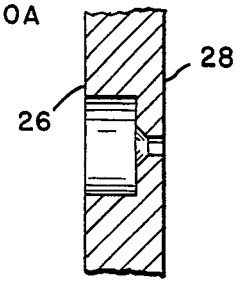
FIGS. 5 and 6 are magnified cross-sectional views that show cross-sectional configurations that could be used for perforations 30.
Figure 6:
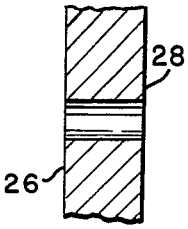

FIGS. 5 and 6 show perforations with counterbored and cylindrical cross-sectional configurations, respectively. A perforation with either a tapered or counterbored cross-sectional configuration is preferred over a cylindrical perforation, because either type of configuration is more likely, than the cylindrical, to transform the flow characteristics of the molten alloy to turbulent flow.

In the case of a perforation that does not have a cylindrical cross-sectional configuration, the flow pattern induced is additionally dependent upon factors including the size of the smallest cross-sectional area of the perforation in the direction of flow, and the difference between the largest and smallest cross-sectional areas of the perforation in the direction of flow. More precisely, a relatively smaller perforation size will be more likely, than a relatively larger perforation size, to produce turbulent flow, and a relatively greater difference between the largest and smallest cross-sectional areas as will be more likely, than a relatiVely smaller difference, to transform the flow to turbulent flow.

Figure 4:
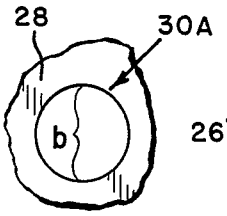

FIG. 2 shows that perforation 30A, which is representative of the perforations of barrier 16, preferably has a tapered cross-sectional configuration. Referring to FIGS. 3 and 4, perforation 30A is preferably oriented so that an area "a" at outer wall 26 of the barrier is greater than an area "b" at inner wall 28. Thus, area "b" is the flow-limiting area for perforation 30A.

Referring to FIG. 4, flow-limiting area "b" must be of a size that allows the inclusions-containing molten alloy to pass through. Accordingly, area "b" will typically have a diameter of about ¼ to 1 inch. Some inclusions may be so large relative to a diameter of about ¼ inch that the perforation will prevent the inclusion from passing through. In such instances, barrier 16 will entrap inclusions, as well as enhance agglomeration.

Referring again to FIG. 2, barrier 16 is arranged over a well block 31, which provides outlet 20, through which the molten alloy passes as it exits from tundish 12. A diameter "f" of outlet 20, which defines the outlet cross-sectional flow area, determines the rate of flow of the molten alloy out of the tundish. Preferably, the sum of flow-limiting areas "b" is more than twice the outlet cross-sectional flow area. However, at a minimum, the sum of areas "b" could be equal to the outlet cross-sectional flow area.

Conveniently, barrier 16 has perforations 30 symmetrically located throughout. However, the perforations could be limited to certain locations on the barrier, such as on the side of the barrier away from ladle 10, or on the upper third of the barrier. Typically, a relatively greater number of perforations wil1 be preferred to a relatively smaller number of perforations.

The conical shape of barrier 16, with an upper diameter "D" thereof being greater than a lower diameter "d" thereof, causes an upper portion 32 of the agglomerated inclusions-enriched molten alloy to flow at a velocity that is relatively lower than the flow velocity of a lower portion 34 of the molten alloy. An upper flow velocity that is less than a lower flow velocity enables the agglomerated inclusions to float to molten alloy surface M. As a result, inclusions are removed from the molten alloy, and removal is effected prior to the alloy passing into outlet 20.

With the lower flow velocity a constant value, a relatively decreased upper flow velocity will produce a relatively enhanced movement of the agglomerated inclusions to the molten alloy surface. Accordingly, a conical shape that is relatively more tapered will produce a relatively enhanced movement of agglomerated inclusions to the molten alloy surface. Although barrier 16 could be cylindrical, it is therefore clear that a conical shape is preferred.

An upper surface 35 of barrier 16 should preferably be a distance below the molten alloy surface sufficient to provide floated agglomerated inclusions within the barrier with free access to the complete molten alloy surface so as to permit escape into the general bath area. Conveniently, upper surface 35 will be about one-half inch below molten alloy surface M, on which a slag layer L floats. The gap between the upper surface and the molten alloy surface could be greater, but it should not be so great that flow of the molten alloy over upper surface 35 to the inside of the barrier, reduces efficient removal of inclusions.

Advantageously, lower diameter "d" of the barrier is greater than diameter "f" of outlet 20. As a result, the molten alloy has free access to the outlet, and in addition, a lower surface 36 of the barrier is situated around the outlet mouth, on well block 31.

Exemplary materials of which the barrier may be made, include, but are not limited to, alumina-graphite, alumina, fused silica, magnesia, and zircon or zirconia, in decreasing order of preference. Preferably, the barrier is made of a material attractive to inclusions such as alumina-graphite. Alternatively, a material that is not attractive to inclusions, such as zircon or zirconia, could be used. If an inclusions-attracting material is used, barrier 16 will also remove inclusions by attractively drawing inclusions out of the molten alloy.

Inserted within well block 31 is an upper nozzle 37, which is preferably porous. The nozzle could be an integral part of the well block, rather than an insert. Argon gas is passed through the porous nozzle, and travels upward through the agglomerated inclusions-enriched molten alloy. As a result, the agglomerated inclusions may be further enabled to float to the molten alloy surface.

Figure 7:
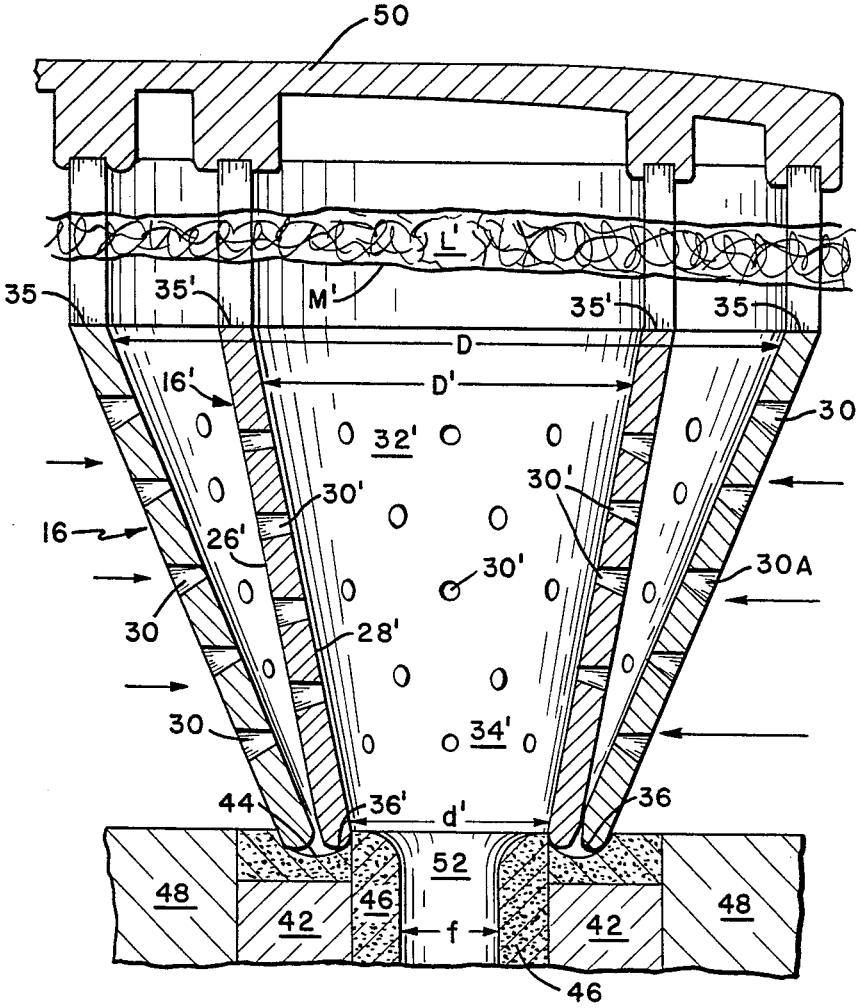
FIG. 7 is a detailed, cross-sectional view of another preferred embodiment of an apparatus in accordance with the present invention.

Referring now to FIG. 7, barrier to flow 16' is shown inserted inside barrier to flow 16, in order to increase the efficiency of inclusions removal. Barriers 16 and 16' have the same features, except that an upper diameter D' and a lower diameter d' of barrier 16' are smaller than diameters D, d of barrier 16, to permit barrier 16' to fit inside barrier 16. Accordingly, for ease of understanding, in FIG. 7, the features of barrier 16' are assigned the numbers of the corresponding features of barrier 16, but are differentiated by use of "'".

Within barriers 16, 16', an upper portion 32' of the agglomerated inclusions-enriched molten alloy flows at a velocity that is relatively lower than the flow velocity of a lower portion 34' of the molten alloy. Barriers 16, 16' are held in place by hold down equipment 50. A slag layer L' floats on molten alloy surface M'.

A well block 42 preferably has a concavity 44, which mates, either dry or mortared, with the lower surfaces 36, 36' of barriers 16, 16' to help position the barriers, and keep the barriers positioned. Inserted within the well block is a porous upper nozzle 46 through which argon gas is passed. Well block 42 provides an outlet 52 through which the molten alloy exits from a tundish 48. A diameter f' of outlet 52 determines the rate of flow of the alloy out of the tundish.

In operation, referring to FIG. 2, with particular focus on unique barrier 16, a molten ferrous-based alloy containing inclusions passes through tapered perforations 30 of barrier 16. The flow characteristics of the molten alloy are sufficiently disturbed within the individual perforations to enhance inclusion agglomeration. As a result, molten alloy exiting from the perforations is agglomerated inclusions-enriched, compared to molten alloy entering the perforations. The conical shape of barrier 16 causes upper portion 32 of the agglomerated inclusions-enriched molten alloy to flow at a velocity that is relatively lower than the flow velocity of lower portion 34 of the molten alloy, thereby enabling the agglomerated inclusions to float to molten alloy surface M. As a result, inclusions are removed from the molten alloy. The molten alloy then exits from tundish 12 through outlet 20 and is fed into a mold (not shown).

In the preceding description of the present invention, there are shown and essentially described only preferred embodiments of this invention, but as mentioned above, it is to be understood that the invention is capable of changes or modifications within the scope of the inventive concept expressed herein. Several changes or modifications have been briefly mentioned for purposes of illustration.

Industrial Applicability

This invention is useful in the continuous casting of ferrous-based alloys, including stainless steel and carbon steel.

I claim:

1. An apparatus useful for the removal of inclusions from a molten ferrous-based alloy in a continuous casting process, said apparatus comprising a replaceable barrier to flow, that has a plurality of flow-altering perforations, the individual perforations allowing an inclusions-containing molten alloy to pass therethrough and yet disturbing molten alloy flow sufficiently to enhance inclusion agglomeration, whereby molten alloy exiting from said perforations is agglomerated inclusions-enriched, compared to molten alloy entering said perforations;

said barrier to flow having an upper diameter that is of a dimension relative to a lower diameter thereof, that enables agglomerated inclusions within the barrier to float to the molten alloy surface; said lower diameter being sufficient to provide free access of the molten alloy to an outlet from a tundish in which said barrier is to be placed, said barrier being arranged above said outlet;

wherein the sum of the flow-limiting, cross-sectional areas of said individual perforations is at least equivalent to the outlet cross-sectional flow area.

2. The apparatus of claim 1, wherein said individual perforations have a first cross-sectional area in the direction of flow that is greater than a second cross-sectional area thereof in the direction of flow, said first cross-sectional area being traversed by the molten alloy prior to said second cross-sectional area.

3. The apparatus of claim 1, wherein said upper diameter of said barrier is greater than said lower diameter.

4. The apparatus of claim 1, wherein said sum of said flow-limiting, cross-sectional areas is more than twice said outlet cross-sectional flow area.

5. The apparatus of claim 1, wherein said barrier has said perforations symmetrically located throughout.

6. The apparatus of claim 1, wherein said barrier is made of a material attractive to said inclusions.

7. The apparatus of claim 6, wherein said material is alumina-graphite.

8. The apparatus of claim 1, further comprising a porous upper nozzle situated below said outlet.

9. An apparatus comprising a first barrier to flow in accordance with claim 3, and a second barrier to flow having the same features as the first barrier to flow except that the second barrier being smaller than, and being inserted inside, the first barrier.

10. In a process for continuous casting of a molten ferrous-based alloy, the improvement comprising passing an inclusions-containing molten alloy through a plurality of flow-disturbing perforations in a barrier to flow, whereby molten alloy flow within the individual perforations is sufficiently altered to enhance inclusion agglomeration so that molten alloy exiting from said perforations is agglomerated inclusions-enriched, compared to molten alloy entering said perforations thereby enabling the agglomerated inclusions to float to the molten alloy surface, whereby inclusions are removed from said molten ferrous-based alloy.

11. The process of claim 10, further comprising bubbling argon gas through the agglomerated inclusions-enriched molten alloy.

* * * * *